United States Patent [19]

Russell et al.

[11] 4,064,375

[45] Dec. 20, 1977

[54] VACUUM STRESSED POLYMER FILM PIEZOELECTRIC TRANSDUCER

[75] Inventors: Kenneth Foden Russell, Baildon; Alex Victor Garner, Leeds, both of England

[73] Assignee: The Rank Organisation Limited, London, England

[21] Appl. No.: 713,529

[22] Filed: Aug. 11, 1976

[30] Foreign Application Priority Data

Aug. 11, 1975 United Kingdom ..... 33339/75

[51] Int. Cl.[2] ..... H04R 17/00

[52] U.S. Cl. ..... 179/110 A; 310/334; 310/344

[58] Field of Search ..... 179/110 A; 310/8.9, 310/9

[56] References Cited

U.S. PATENT DOCUMENTS

| | | | |
|---|---|---|---|
| 2,565,159 | 8/1951 | Williams | 179/110 A |
| 2,895,062 | 7/1959 | Abbott | 179/110 A |
| 3,894,198 | 7/1975 | Murayama et al. | 179/110 A |

*Primary Examiner*—George G. Stellar

*Attorney, Agent, or Firm*—Brisebois & Kruger

[57] ABSTRACT

An electro-acoustic transducer has a piezo-electric film polymer diaphragm which is stressed to a part spherical surface and the periphery of which is clamped. Electrodes placed over the surface of the diaphragm apply an electric field transverse the plane thereof which causes elongation parallel to the plane of the diaphragm. The rim of the diaphragm is mounted in a supporting framework which forms part of an enclosure isolating one side of the diaphragm from the atmosphere. The enclosure may be evacuated to improve the performance of the transducer by avoiding problems due to the formation of standing waves within the enclosure.

5 Claims, 2 Drawing Figures

VACUUM STRESSED POLYMER FILM PIEZOELECTRIC TRANSDUCER

Figure 1:
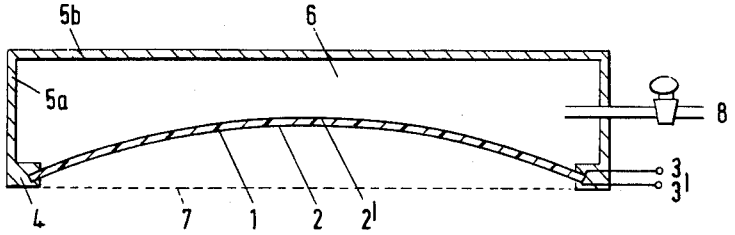

The present invention relates to tranducers, particularly to electro-acoustic transducers suitable for use as loudspeakers.

There has been considerable interest recently in the so called "flat" loudspeakers, which take up less space in a domestic environment, and which can, in certain circumstances, have good acoustical properties. The term "flat" in relation to loudspeakers refers to the external shape of the loudspeaker, and is taken to mean one in which the thickness is very much less than the other dimensions. Typically, the thickness may be 20% of the next larger dimension, or less in the case of the so-called "picture frame" loudspeakers which are intended to be hung on a wall.

Known such "flat" loudspeakers utilise a stiff, light, thin diaphragm produced from material such as, for example, expanded polystyrene. The high mechanical Q of such materials, however, is very difficult to damp, and the break-up modes of such a diaphragm give sound reproduction having a very marked colouration. Such colouration is a disadvantage when it is desired to faithfully reproduce the sounds represented by electrical signals sent to the loudspeaker.

The so-called "flat" loudspeakers may be provided with conventional moving-coil drive units, or with evenly-driven soft diaphragms working electrostatically or in a planar magnetic field, and the acoustic output from the diaphragm of such a loudspeaker can be of very high quality, but such loudspeakers have a major defect in the strong cavity effect due to the flat design. The cavity effect modifies the acoustic signals produced by the loudspeaker, and one of the most objectionable defects is caused by a dominant standing wave set up between the large flat surface of the diaphragm and the rear of the supporting structure (or the wall of the room) which determines the frequency of the colouration of the acoustic signals. Such "flat" loudspeakers are also prone to the deleterious effect of cancellations which may occur at the low frequency end of the sound spectrum due to reflections from the rear of the structure (or the wall of the room).

The present invention relates to an electro-acoustic transducer suitable for use as a loudspeaker and in which, by making certain suitable provisions, the disadvantages of known "flat" loudspeakers can be at least substantially reduced if not entirely removed. This is achieved by making use of a film material which exhibits the piezo-electric effect as the diaphragm of the transducer. It has been found that if a material such as a vinylidene fluoride polymer or copolymer is stretched and polarised, the piezo-electric properties of the film are anisotropic and when the direction of an applied field is perpendicular to the plane of the film the direction of deformation of the film due to the piezo-electric effect is, largely, parallel to the plane of the film. This fact has been utilised in making electro-acoustic transducers by stressing a film of such material to a curved shape by suitably holding it along at least some of the edges, and using the curved film as the transducer diaphragm by applying across it an A.C. field representing the desired acoustic vibrations to be produced by the transducer. Extension of the diaphragm in its plane, because the edges are clamped, thus causes displacement of the diaphragm transverse its plane to produce the required acoustic vibrations.

According to the present invention, there is provided an electro-acoustic transducer incorporating a diaphragm made of a film polymer having piezo-electric properties, the diaphragm being stressed to a curved shape in cross-section, provided with electrodes on each face thereof, and supported at its periphery, by a substantially rigid supporting framework which comprises or forms part of an enclosure sealing one face of the diaphragm from the atmosphere.

As in conventional loudspeakers, the electrodes are fed from a source of alternating current signals representing the frequencies of the acoustic vibration to be produced by the transducer. The electrodes on opposite faces of the diaphragm thus set up an electric field passing perpendicularly through the plane of the diaphragm, and as described above the piezo-electric effect within the film material causes the diaphragm to expand or contract parallel to its plane. In a diaphragm which is curved in cross-section the term "plane" will be understood to refer to a curved surface parallel the surfaces of the diaphragm.

The electrodes may be attached to the surfaces of the diaphragm in any suitable manner, and may cover substantially the whole free unsupported area of the faces or may cover only selected areas if it is found that this beneficially affects the performance of the diaphragm.

Of the various ways in which the electrodes may be attached to the faces of the diaphragm, electro-deposition is probably the most practical, although thin conductive layers may be secured to the diaphragm by adhesive, or any other suitable technique.

The enclosure sealing one face of the diaphragm from the atmosphere is preferably evacuated so that transmission of acoustic vibrations from the diaphragm into the enclosure is substantially reduced, or even eliminated if the vacuum is sufficiently low.

If the diaphragm and the material from which the enclosure is formed are totally impermeable to air the enclosure may merely be sealed when the vacuum has been formed and the vacuum will remain, providing the edges of the diaphragm are sufficiently well sealed to the supporting framework, without further attention. In the event of the possibility of some slight leakage of air into the diaphragm enclosure, however, there may be provided means for maintaining a predetermined vacuum level in the enclosure. Such means may include, for example, a small vacuum pump controlled to operate whenever the transducer is fed with electrical signals.

Figure 2:
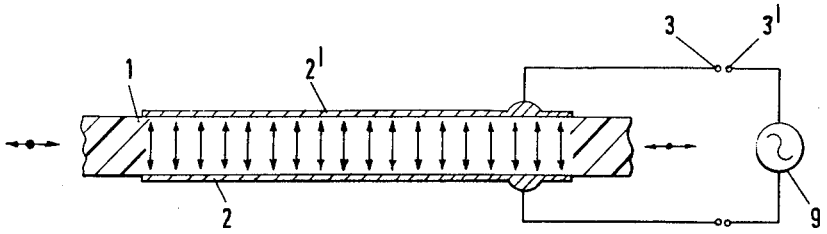

One embodiment of the invention will now be more particularly described, by way of example, with reference to the accompanying drawings, in which:

FIG. 1 is a schematic cross-sectional view of a transducer formed as an embodiment of the present invention; and FIG. 2 is an enlarged cross-sectional view, in diagrammatic form, of a part of a diaphragm suitable for use in the embodiment of FIG. 1.

Referring now to the drawings, it will be seen that the embodiment shown comprises a sealed, flat, hollow structure which has as part of one of its major surfaces, a diaphragm including a polymer having piezo-electric properties. The diaphragm 1 is made from a film polymer with piezo-electric properties, such as, for example, polyvinylidene fluoride. The diaphragm is supported all around its periphery by a supporting framework 4 which, together with side walls 5*a*, and a rear wall 5*b* forms an enclosure 6. The diaphragm 1 is larger than the area defined by the supporting framework 4 and the enclosure 6 is evacuated through a suitable valve outlet such as that shown diagrammatically by the reference numeral 8. The evacuation of the enclosure 6 causes the diaphragm 1 to bow inwardly to adopt an ovoid or part-spherical shape as indicated in FIG. 1.

Coated on each side of the diaphragm 1, as shown more particular in FIG. 2, are two electrodes, 2, 2' which are secured to the diaphragm by means of vacuumdeposition. The electrodes 2, 2' must be very light, typically less than half of the mass of the diaphragm. Electrical connection is made to the electrodes on either side of the diaphragm 1 by means of terminals 3, 3' which provide for an electrical signal to be applied to each side of the diaphragm from an amplifier or voltage generator 9.

The level of the vacuum in the interior 6 of the enclosure formed by the side walls 5*a*, the rear wall 5*b* and the diaphragm 1 is such that the transmission of acoustic energy from the diaphragm rearwardly into the interior of the enclosure is substantially reduced. If the enclosure is not entirely airtight and allows a slow drift of air molecules into the interior 6 the outlet 8 may also be provided with a vacuum pump in order to maintain the evacuated space at the desired reduced pressure.

The exposed face of the diaphragm 1 may be hidden by a screen 7, which must be acoustically transparent, which is stretched over the framework 4 and provides a decorative function.

When a fluctuating voltage representing the acoustic signal to be reproduced by the transducer is applied through the terminals 3, 3' to the electrodes on each surface of the diaphragm, a varying electrical field is set up through the thickness of the diaphragm by the electrodes 2, 2'. The strength and direction of the electric field varies directly with changes in the strength and direction of the electric current in the signal applied to the terminals 3, 3'. The piezo-electric effect in the material of the diaphragm causes the material to expand or contract in dependence on the direction of the electric field, in a direction orthogonal to the direction of the electric field. Since this passes transversely through the thickness of the diaphragm, the expansion and contraction of the diaphragm takes place in the plane of the diaphragm, the term "plane" of a curved surface being as defined above.

Since the diaphragm is clamped over the whole of its periphery, the alternate expansions and contractions cause the diaphragm to vibrate about a mean position to generate acoustic pressure waves therefrom. The mean or rest position of the diaphragm is determined by the elasticity of the film used, and the degree of evacuation of the interior space 6 within the enclosure.

Since acoustic energy cannot readily propagate rearwardly from the diaphragm 1 into the space 6 there can be little or no acoustic standing waves produced between the diaphragm and the rear walls 5*b* so that interference with the propagation of the sound from the front face of the diaphragm into the listening area is therefore undistorted.

Cavity effects, previously troublesome with "flat" construction loudspeakers are thus substantially reduced since the interior space 6 does not represent a "cavity" capable of sustaining acoustic energy. The construction described as an embodiment of the present invention is particularly suitable for use as a "flat" loudspeaker which may be hung unobtrusively on a wall and which will operate without the gross distortions caused by sound radiated in the direction of the wall, which distortions are present in all other known transducer constructions used in this way.

We claim:

1. An electro-acoustic transducer of the type having a vibratable diaphragm made of a film polymer having piezo-electric properties, means stressing said diaphragm to a curved shape in cross-section, and electrodes on each face of said diaphragm, the improvement wherein, there are means supporting the periphery of said diaphragm, said means being incorporated in part of an enclosure sealing one face of said diaphragm from the atmosphere, and stressing of said diaphragm to a curved shape is obtained by evacuation of said enclosure.

2. The electro-acoustic transducer of claim 1, wherein said electrodes are attached to the faces of said diaphragm over selected areas thereof.

3. The electro-acoustic transducer of claim 1, wherein said electrodes are attached to the faces of said diaphragm over substantially the whole free unsupported area thereof.

4. The electro-acoustic transducer of claim 1, wherein said electrodes are formed on the faces of said diaphragm by electro-deposition.

5. The electro-acoustic transducer of claim 1, wherein there are provided means for maintaining a predetermined vacuum in said enclosure.

* * * * *